US005842706A

United States Patent [19]

Chang

[11] Patent Number: 5,842,706

[45] Date of Patent: Dec. 1, 1998

[54] SKATE HAVING SIMPLIFIED ACCELERATING DEVICE

[76] Inventor: Sreter Chang, No. 451, TA Tien Road, Homei Chen, Chang Hua Hsien, Taiwan

[21] Appl. No.: 861,788

[22] Filed: May 22, 1997

[51] Int. Cl.[6] ..... A63C 17/04

[52] U.S. Cl. ..... 280/11.28; 280/11.22; 280/11.27

[58] Field of Search ..... 280/11.22, 11.26, 280/11.27, 11.3, 11.31, 11.33, 11.34, 11.23, 11.24, 614, 615, 842, 636, 607, 11.15, 11.115

[56] References Cited

U.S. PATENT DOCUMENTS

| | | | |
|---|---|---|---|
| 1,789,182 | 1/1931 | Klevstad | 280/11.15 |
| 2,174,990 | 10/1939 | Maguire | 280/11.115 |
| 4,002,354 | 1/1977 | Ramer | 280/614 |
| 5,503,413 | 4/1996 | Belogour | 280/11.22 |

*Primary Examiner*—Russell D. Stormer
*Assistant Examiner*—Jason Morrow
*Attorney, Agent, or Firm*—Beveridge, DeGrandi, Weilacher & Young, L.L.P.

[57] ABSTRACT

A skate having simplified accelerating device generally includes a truck having a plurality of rollers rotationally mounted thereunder. A boot is pivotally installed to the front portion of the truck by means of a shaft pin. The rear portion of the truck is provided with a mounting socket which has an opening at the top and a threaded portion at bottom. The threaded portion can be readily sealed by a plug having a dowel thereof. The boot is provided with a mounting boss corresponding to the mounting socket of the truck. A circular guiding post having a bottom flange is slidably inserted into the mounting socket of the truck. The top of the circular guiding post is fixedly connected to the mounting boss of the boot. The outer diameter of the flange of the circular guiding post is larger than the upper opening of the socket such that the circular guiding post is limited within the socket. A spring member having a longer length than the circular guiding post is disposed and inserted within the circular guiding post and both ends of the spring member are biased by the mounting boss and the plug disposed at bottom the socket of the truck. By this arrangement, the boot is biased upward respect to the truck by the extension of the compressed spring member. When the user lifts his/her leg, the truck is still contacted with the ground without floating above the ground, accordingly, the weight of the truck will not become a heavy load to the user when the leg is lifted while the tip of the truck may still be used to kick back to push the body forward. As a result, the in-line skate can be quickly accelerated with less energy while the speed is increased.

2 Claims, 3 Drawing Sheets

SKATE HAVING SIMPLIFIED ACCELERATING DEVICE

FIELD OF THE INVENTION

The present invention relates to a skate, more particularly, to a skate having a simplified accelerating device wherein the skate can be quickly accelerated with little energy exerted by the user. The skate having simplified accelerating device generally includes a truck having a plurality of rollers rotationally mounted thereunder. A boot is pivotally installed to the front portion of the truck by means of a shaft pin. The rear portion of the truck is provided with a mounting socket which has an opening at the top and a threaded portion at the bottom. The threaded portion can be readily sealed by a plug having a dowel extending therefrom. The boot is provided with a mounting boss corresponding to the mounting socket of the truck. A circular guiding post having a bottom flange is slidably inserted into the mounting socket of the truck. The top of the circular guiding post is fixedly connected to the mounting boss of the boot. The outer diameter of the flange of the circular guiding post is larger than the upper opening of the socket such that the circular guiding post is limited within the socket. A spring member having a length longer than the circular guiding post is disposed and inserted within the circular guiding post and the spring member is biased between the mounting boss and the plug disposed at the bottom of the socket of the truck. By this arrangement, the boot is biased upward with respect to the truck by the extension of the compressed spring member. When the user lifts his/her leg, the truck maintains contact with the ground surface without floating above the ground. Accordingly, the weight of the truck will not become a heavy load to the user when the leg is lifted while the tip of the truck may still be used to kick back to push the body forward. As a result, the in-line skate can be quickly accelerated with less energy while the speed is increased.

DESCRIPTION OF PRIOR ART

Use of in-line skates is widely spread and accepted around the world and the conventional roller skate has been successfully replaced by this new type of skate. This in-line skate is similar to a ski, however it can be rolled on any flat surface without any limitations. This in-line skate generally comprises a boot and a truck riveted integrally to the boot. This inline skate is mainly made from ABS material and is lighter than the conventional roller skate. Furthermore, the risk of injury is also smaller than that of using the skis. Since almost all rigid surfaces may serve as a playing ground, many a youth are playing this sport in parks or squares.

However, according to the skilled in-line skater, it order to get the in-line skate to cruise or accelerate, the user shall cruise on the ground with one leg/skate while kicking back with the another let/skate. By alternative movements, the skate may go faster and faster. Once the cruise speed is lowered, the user needs to repeat the movement described above to make the skate goes faster and faster again. However, when the accelerating movement is performed, the user needs to lift his/her leg together with the skate, then kick backward to push his/her body forward. As the skate has a certain weight, the repetitive movement will make the muscle of both feet tire quickly. The willingness to participate in this sport continuously is reduced.

SUMMARY OF THE INVENTION

It is the objective of this invention to provide a simplified accelerating device wherein the skate can be quickly and easily accelerated.

In order to achieve the objective set forth, the simplified accelerating device generally includes a truck having a plurality of rollers rotationally mounted thereunder, and a boot pivotally installed to the front portion of the truck by means of a shaft pin. The rear portion of the truck is provided with a mounting socket which has an opening at the top and a threaded portion at the bottom. The threaded portion can be readily sealed by a plug having a dowel extending therefrom. The boot is provided with a mounting boss corresponding to the mounting socket of the truck. A circular guiding post having a bottom flange is slidably inserted into the mounting socket of the truck. The top of the circular guiding post is fixedly connected to the mounting boss of the boot. The outer diameter of the flange of the circular guiding post is larger than the upper opening of the socket such that the circular guiding post is limited within the socket. A spring member having a length longer than the circular guiding post is disposed within the circular guiding post and the spring member is biased between the mounting boss and the plug disposed at the bottom of the socket of the truck. By this arrangement, the boot is biased upward with respect to the truck by the extension of the compressed spring member. In light of this, when the user lifts his/her leg, the truck maintains contact with the ground without floating above the ground. Accordingly, the weight of the truck will not become a heavy load to the user when the leg is lifted while the tip of the truck may still be used to kick back to push the body forward. In light of this, the in-line skate can be quickly accelerated with less energy while the speed is increased.

According to one aspect of the present invention, the curvature of the circular guiding post corresponds to the radius centered on the pin shaft of the truck to the circular guiding post.

BRIEF DESCRIPTION OF DRAWINGS

In order that the present invention may more readily be understood, the following description is given, merely by way of example with reference to the accompanying drawings, in which.

DETAILED DESCRIPTION OF PREFERRED EMBODIMENT

Figure 1:
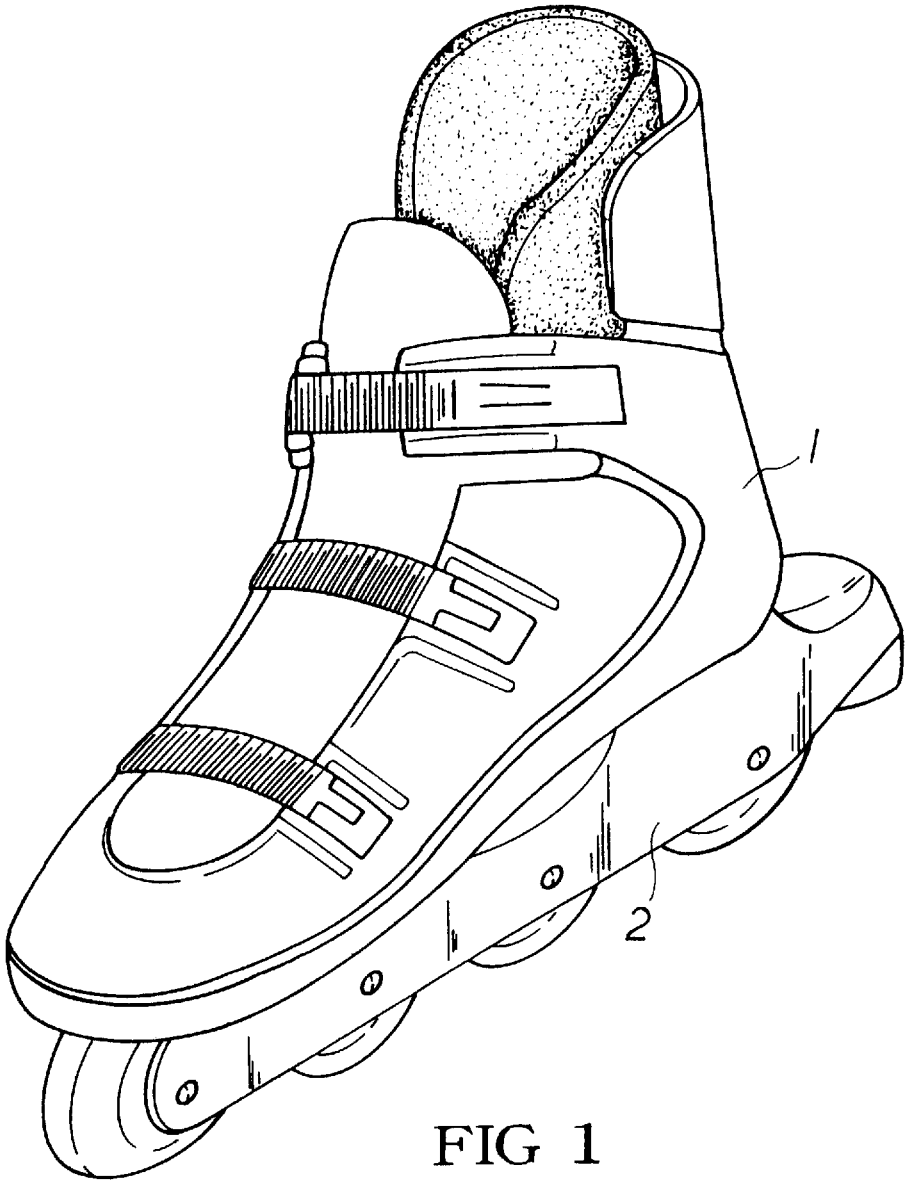
FIG. 1 is a perspective view of the in-line skate.
Figure 2:
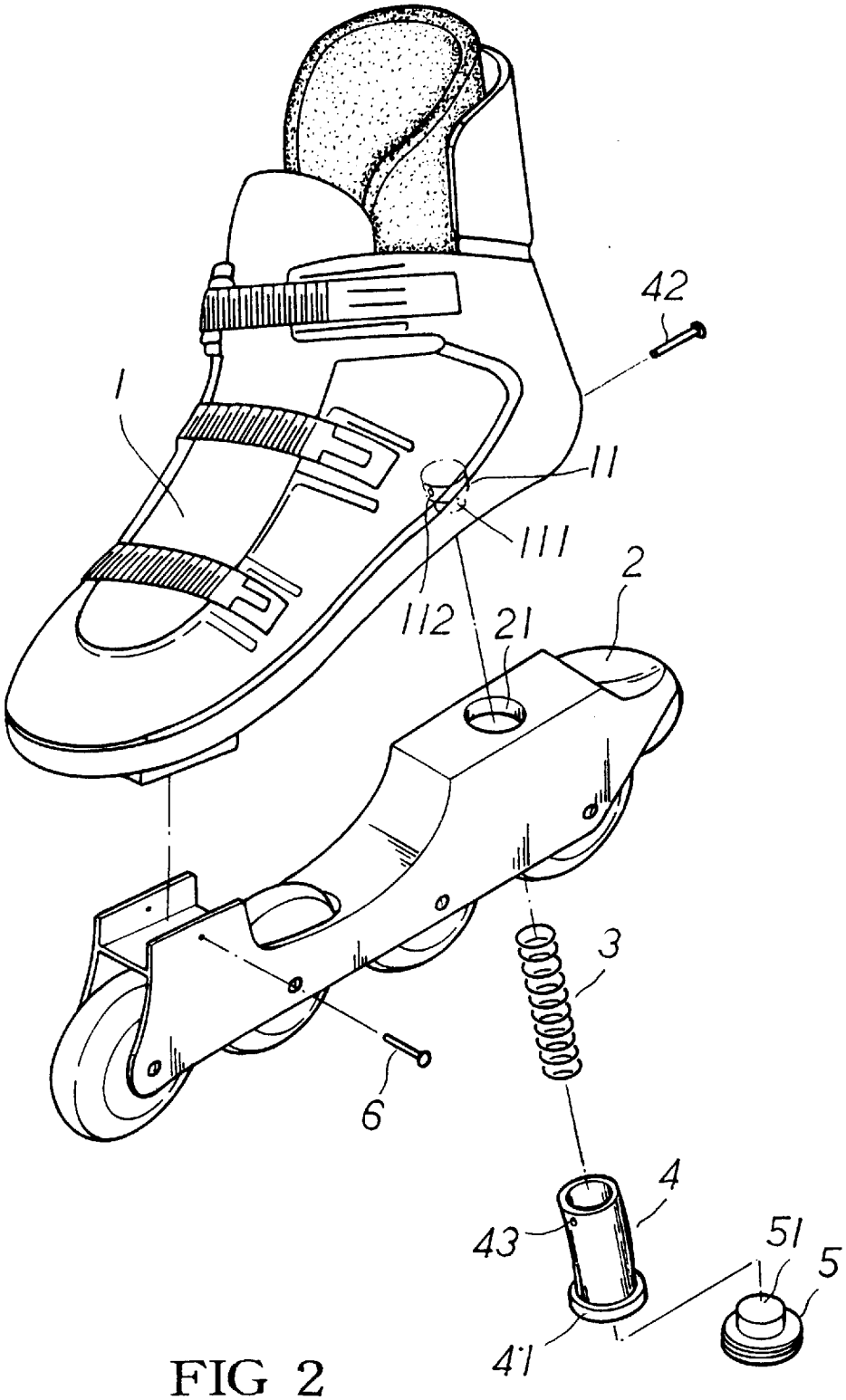
FIG. 2 is an exploded perspective view of the in-line skate made according to the present invention.
Figure 3:
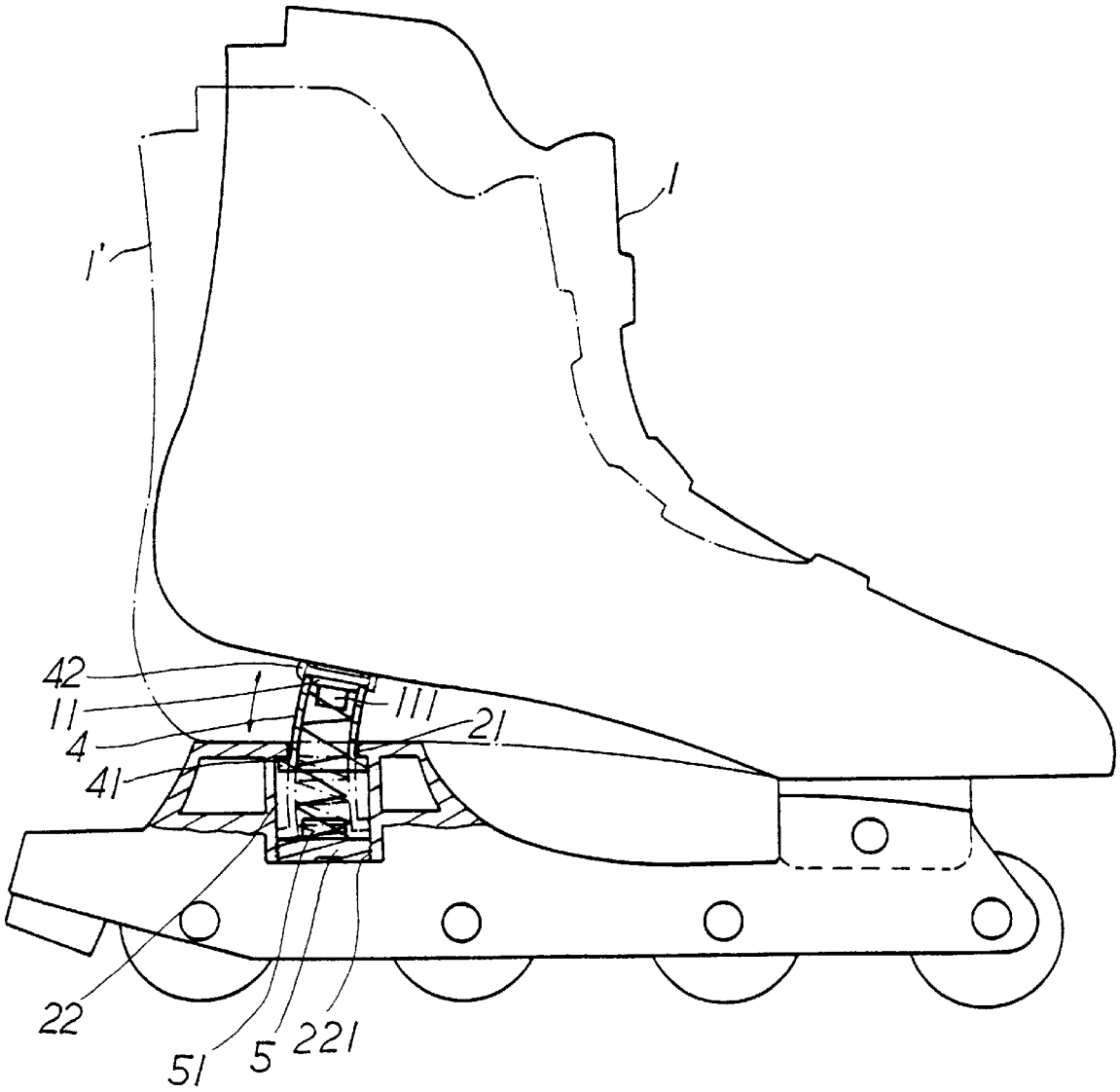
FIG. 3 is a cross sectional view of the in-line skate incorporated with the simplified accelerating device made according to the present invention.

Referring to FIGS. 1 and 2, the simplified accelerating device generally includes a truck 2 having a plurality of rollers rotationally mounted thereunder, and a boot 1 pivotally installed to the front portion of the truck 2 by means of a shaft pin 6. Refer now also to FIG. 3. The rear portion of the truck 2 is provided with a mounting socket 22 which has an opening 21 at the top and an opening having threaded portion 221 at the bottom. The threaded portion 221 can be readily sealed by a plug 5 having a dowel 51 extending therefrom. The boot 1 is provided with a mounting boss 11, having a traverse pin hole 112 thereof, corresponding to the mounting socket 22 of the truck 2. A circular guiding post 4 having a bottom flange 41 is slidably inserted into the mounting socket 22 of the truck 2 from the bottom. The top of the circular guiding post 4 is also provided with a pair of opposite pin holes 43 which are corresponding to the traverse pin hole 111 of the mounting boss 11. A locking pin 42 can be applied to lock the top of the circular guiding post 4 to the mounting boss 11 by passing through the pin holes 112 and holes 43. The outer diameter of the flange 41 of the circular guiding post 4 is larger than the upper opening 21 of the socket 22 such that the circular guiding post 4 is limited within the socket 22.

A spring member 3 having a length longer than the circular guiding post 4 is inserted and disposed within the circular guiding post 4 and the spring member 3 is biased between the mounting boss 11 and the dowel 51 of the plug 5 after the plug 5 is locked to the threaded portion 221 of the socket 22 of the truck 2. By this arrangement, the boot 1 is biased upward with respect to the truck 2 by the extension of the compressed spring member 3.

The curvature of the circular guiding post 3 is corresponding to the radius from and centered on the pin shaft 6 of the truck 2 to the circular guiding post 4. By this arrangement, the boot 1 can be bounced upward and downward respect to the truck 2 as centered on the pin shaft 6 and by the help of the compressed spring member 3 and the circular guiding post 4 which moves along the opening 21 of the socket 22. When the boot 1 is slightly lifted as when the leg is lifted for accelerating, the truck 2 will be pushed downward such that the truck 2 is still contacted with the ground without increasing the load to the leg.

Referring to FIG. 3, in actual practice, the boot 1 can be readily lifted without the truck 2 as, shown in solid line. When the leg is lowered, the spring member 3 is pushed down and rested on the truck 2 to support all the weight of the user and cruise forward. As the spring member 3 is suitably guided by the circular guiding post 3, and it will not be damaged or deformed during the alternative movement of the legs while the speed can be readily accelerated.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A skate, comprising:

a boot having a mounting boss on an underside of a rear portion thereof;

a truck pivotally coupled with said boot at front portions thereof, respectively, such that a pivot axis is defined thereby, said truck including a mounting socket positioned in correspondence with said mounting boss, said mounting socket having a first flanged end and a second end;

a plug engaged at said second end of said mounting socket;

a guide post having a curved shape and including a first end and a second end, said first end having a chamber a guide post flange extending peripherally therefrom and said second end being coupled with said mounting boss, said guide post flange being slidably received in said mounting socket and slidable movement of said guide post relative to said mounting socket being limited by contact between said guide post flange and said first flanged end of said mounting socket and by contact between said guide post flange and said plug engaged at said second end of said mounting socket; and a spring disposed in compression inside a chamber of said guide post, said spring being biased between said mounting boss of said boot and said plug engaged in said second end of said mounting socket.

2. The skate defined in claim 1, wherein:

said curved shape of said guide post corresponds to a radius of curvature associated with a distance between said pivot axis and said guide post.

* * * * *